US009189988B2

(12) United States Patent
Tu et al.

(10) Patent No.: US 9,189,988 B2
(45) Date of Patent: Nov. 17, 2015

(54) MANAGEMENT OF DISPLAY PARAMETERS IN COMMUNICATIONS DEVICES

(75) Inventors: Jerome C. Tu, Saratoga, CA (US); Olivier Boireau, Los Altos, CA (US); Isabel Mahe, Los Altos, CA (US); Wen Zhao, Cupertino, CA (US); Yury Fomin, Pleasonton, CA (US); Jianxiong Shi, Pleasonton, CA (US); Alexander Fertelmeister, Cupertino, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1036 days.

(21) Appl. No.: 11/638,942

(22) Filed: Dec. 14, 2006

(65) Prior Publication Data

US 2008/0143694 A1 Jun. 19, 2008

(51) Int. Cl.
*G09G 3/20* (2006.01)

(52) U.S. Cl.
CPC ..... *G09G 3/2096* (2013.01); *G09G 2320/08* (2013.01); *G09G 2340/0435* (2013.01)

(58) Field of Classification Search
CPC ..... G09G 3/2096; G09G 2320/08; G09G 2340/0435
USPC ..... 455/63.1, 67.13, 67.14, 67.15, 114.2, 455/457, 501, 296, 158.4; 345/204, 213
See application file for complete search history.

(56) References Cited

U.S. PATENT DOCUMENTS

| | | | | |
|---|---|---|---|---|
| 6,191,827 | B1 * | 2/2001 | Segman et al. | 348/746 |
| 6,822,402 | B1 * | 11/2004 | Poindexter | 315/291 |
| 2003/0198307 | A1 * | 10/2003 | Neill et al. | 375/346 |
| 2004/0183822 | A1 * | 9/2004 | Woo | 345/691 |
| 2004/0239591 | A1 * | 12/2004 | Sekii | 345/60 |
| 2005/0181770 | A1 * | 8/2005 | Helferich | 455/413 |
| 2006/0050179 | A1 * | 3/2006 | Kang | 348/565 |
| 2007/0045834 | A1 * | 3/2007 | Chong et al. | 257/734 |

* cited by examiner

*Primary Examiner* — Michael Mapa
(74) *Attorney, Agent, or Firm* — Norton Rose Fulbright US LLP

(57) ABSTRACT

Techniques involving the management of display parameters are disclosed. For example, an apparatus may include a display, a radio module, and a control module. The display employs various operational parameters, which can take on different values. Exemplary parameters include refresh rate and/or pixel clock rate. The radio module may receive a wireless signal at one or more reception frequencies. The control module may select values for these operational parameters of the display. This selection may be made according to characteristics of interference that would be emitted from the display at the one or more reception frequencies. Upon making this selection, the control module may direct the display to employ the selected parameter values.

17 Claims, 6 Drawing Sheets

MANAGEMENT OF DISPLAY PARAMETERS IN COMMUNICATIONS DEVICES

BACKGROUND

Mobile computing devices, such as smart phones, may provide various processing capabilities. For example, mobile devices may provide personal digital assistant (PDA) features, including word processing, spreadsheets, synchronization of information (e.g., e-mail) with a desktop computer, and so forth.

In addition, such devices may have wireless communications capabilities. More particularly, mobile devices may employ various communications technologies to provide features, such as mobile telephony, mobile e-mail access, web browsing, and content (e.g., video and radio) reception. Exemplary wireless communications technologies include cellular, satellite, and mobile data networking technologies.

These devices may include displays that operate according to various parameters. Signals associated with such parameters may generate interference (either wired or wireless) that may compromise wireless signals being received from various networks. Techniques for mitigating interference are desired.

DETAILED DESCRIPTION

Various embodiments may be generally directed to techniques for controlling display parameters. For instance, an apparatus may include a display, a radio module, and a control module. The display employs various operational parameters, which can take on different values. Exemplary parameters include refresh rate and/or pixel clock rate. The radio module may receive a wireless signal at one or more reception frequencies. The control module may select values for these operational parameters of the display. This selection may be made according to characteristics of interference that would be emitted from the display at the one or more reception frequencies. Upon making this selection, the control module may direct the display to employ the selected parameter values.

Through the setting of display parameters, interference imparted to the received wireless signals may be reduced. Thus, improvements may be attained in the quality of wireless signals received by the transceiver.

Embodiments of the present invention may involve a variety of wireless communications technologies. These technologies may include cellular and data networking systems. Exemplary data networking systems include wireless local area networks (WLANs), wireless metropolitan area networks (WMANs), and personal area networks (PANs).

Various embodiments may comprise one or more elements. An element may comprise any structure arranged to perform certain operations. Each element may be implemented as hardware, software, or any combination thereof, as desired for a given set of design parameters or performance constraints. Although an embodiment may be described with a limited number of elements in a certain topology by way of example, the embodiment may include other combinations of elements in alternate arrangements as desired for a given implementation. It is worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1A:
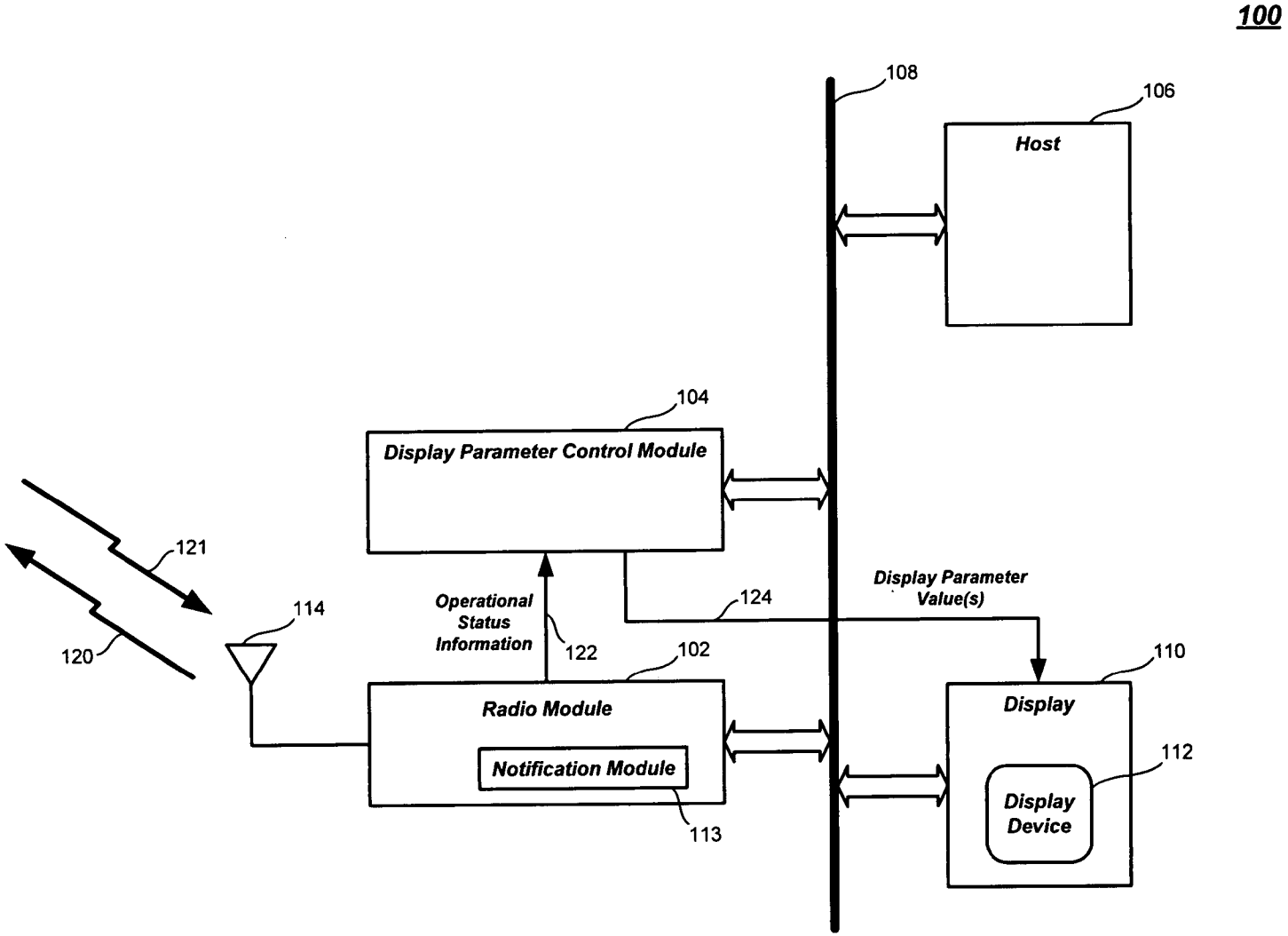
FIG. 1A illustrates an embodiment of an apparatus.

FIG. 1A illustrates one embodiment of an apparatus that may communicate across wireless links. In particular, FIG. 1A shows an apparatus 100 comprising various elements. The embodiments, however, are not limited to these depicted elements. FIG. 1A shows that apparatus 100 may include a radio module 102, a display parameter control module 104, a host 106, an interconnection medium 108, and a display 10. These elements may be implemented in hardware, software, firmware, or in any combination thereof.

FIG. 1A shows that radio module 102 may transmit and receive wireless signals 120 and 121 through an antenna 114. Thus, radio module 102 may include components, such as modulators, demodulators, amplifiers, filters, and so forth. Such components may be implemented with hardware (e.g., electronic circuitry), software, firmware, or combinations of these.

Radio module 102 may communicate with remote devices across various types of wireless links. For example, radio module 102 may communicate across data networking links. Examples of such data networking links include wireless local area network (WLAN) links, such as IEEE 802.11 WiFi links. Further examples include wireless metropolitan area (WMAN) links, such as IEEE 802.16 WiMax links and IEEE 802.16e WiBro links. Yet further examples include WiMedia/Ultra Wide Band (UWB) links (such as ones in accordance with Ecma International standards ECMA-368 and ECMA-369). Also, exemplary data networking links include personal area networks (PAN) links such as Bluetooth links, and WiBree (initially developed by Nokia Research Centre) links. The embodiments, however, are not limited to these examples.

Alternatively or additionally, radio module 102 may communicate across wireless links provided by one or more cellular systems. Exemplary cellular systems include Code Division Multiple Access (CDMA) systems, Global System for Mobile Communications (GSM) systems, North American Digital Cellular (NADC) systems, Time Division Multiple Access (TDMA) systems, Extended-TDMA (E-TDMA) systems, Digital Advanced Mobile Phone Service (IS-136/TDMA) systems, Narrowband Advanced Mobile Phone Service (NAMPS) systems, third generation (3G) systems such as Wide-band CDMA (WCDMA), CDMA-2000, Universal Mobile Telephone System (UMTS), cellular radiotelephone systems compliant with the Third-Generation Partnership Project (3GPP), and so forth. However, the embodiments are not limited to these examples. For example, various 4G systems may be employed.

Display 110 includes a display device 112 that may provide visual output to a user. Such output may be in the form of text, graphics, images, and/or video. Display device 112 may be implemented with various technologies. For instance, display device 112 may be a liquid crystal display (LCD) having a plurality of elements (e.g., pixels). The embodiments, however, are not limited to this context. For instance, display device 112 may employ other technologies, such as light emitting diodes (LEDs), plasma display panels (PDPs), and so forth.

In addition, display 110 may include various circuitry, logic, and/or software to operate display device 112. Examples of such components may include a pixel clock, refresh circuitry, and so forth. These components may be implemented on a substrate or platform, such as a printed circuit board (PCB).

During operation, display 110 may operate according to various parameters. Exemplary parameters include refresh rate and pixel clock rate. However, the embodiments are not limited to these parameters. Refresh rate is associated with refresh techniques that display 110 may employ. Such techniques provide for image elements (e.g., pixels) of display device 112 to be periodically updated, activated and/or deactivated. The refresh rate is the rate at which such actions occur.

Pixel clock rate refers to a rate at which image data (e.g., pixel data indicating pixel intensity and color, as well as other information) is transmitted to a storage medium or buffer (e.g., a frame buffer) that drives the display device. For example, this rate may correspond to clock signal(s) generated by pixel clock circuitry. Thus, the pixel clock drives the communication of signals (e.g., digital signals) to the display. These signals can leak out and impact radio receivers.

As described above, the embodiments are not limited to refresh rate and pixel clock rate. For instance, embodiments may control parameter values that effect the properties of other electrical signals (e.g., display control signals) associated with the operation of display 110.

Display parameter control module 104 may direct or control one or more operational parameters employed by display 110. For instance, FIG. 1A shows display parameter control module 104 sending a display parameter control directive 124 to display 110. Control directive 124 may be based on operational status information 122, which display parameter control module 104 receives from radio module 102. Operational status information 122 may be generated from a notification module 113 that is included within radio module 102.

Display parameter control directive 124 and operational status information 122 may be implemented in various ways. For example, they may be implemented as signals allocated to various signal lines. However, further embodiments may alternatively employ data messages. These data messages may be sent across various connections. Exemplary connections include parallel interfaces, serial interfaces, and bus interfaces. As described below, such interfaces may be provided by interconnection medium 108.

Host 106 may exchange information with radio module 102. As shown in FIG. 1A, such exchanges may occur across interconnection medium 108. For instance, host 106 may send information to these radio modules for wireless transmission. Conversely, radio module 102 may send information to host 106 that was received in wireless transmissions. In addition, host 106 may exchange information with radio module 102 regarding the radio module's configuration and operation. Examples of such information include control directives sent from host 106 to radio module 102.

Furthermore, host 106 may perform operations associated with one or more protocols (e.g., multiple protocols at various layers). Additionally, host 106 may perform operations associated with user applications. Exemplary user applications include telephony, text messaging, e-mail, web browsing, word processing, and so forth. Moreover, host 106 may provide one or more functional utilities that are available to various protocols, operations, and/or applications. Exemplary utilities include operating systems, device drivers, user interface functionality, and so forth.

Interconnection medium 108 provides for couplings among elements, such as radio module 102 and host 106. Thus, interconnection medium 108 may include, for example, one or more bus interfaces. Exemplary interfaces include Universal Serial Bus (USB) interfaces, as well as various computer system bus interfaces. Additionally or alternatively, interconnection medium 108 may include one or more point-to-point connections (e.g., parallel interfaces, serial interfaces, etc.) between various element pairings. In embodiments, interconnection medium 108 may provide for the exchange of operational status information 122 and parameter control directive 124, as described above.

In general operation, apparatus 100 may engage in wireless communications. However, components within apparatus 100 may interfere with the reception of signals 121. This may result in link outages, unacceptable symbol error rates, as well as other problems.

For example, such interference may occur through signals (either wireless or wired) emanating from display 110. These interfering signals may have spectral characteristics determined (in whole or in part) by parameters that display 110 employs. As described above, such parameters may include refresh rate, pixel clock rate, and/or other parameters.

Signals from display 110 may emanate through various mechanisms. For example, signals (e.g., digital signals) driving display device 112 (as well as their harmonic components) may leak from conductive wires, leads, or traces on a printed circuit board and be radiated into the air in an unintended fashion. These radiated signals may be received by a radio module's antenna, such as antenna 114. Upon receipt, these signals become interference signals. Such interference is referred to as radiated interference.

Another type of interference may propagate within a device or apparatus. For instance, display driving signals (and their harmonic components) may couple onto unintended paths within the system. Such paths may be on printed circuit boards, as well as other hardware. For example, coupling may occur through ground loops, through the power plane, as well as between traces across circuit board layers. Such coupling may cause the signals to inadvertently end up within a radio module's reception components. As a result, intended received signals may become corrupted. This type of interference is referred to as conducted interference.

Embodiments may address both of these interference mechanisms (as well as other mechanisms). For instance, when radio module 102 receives signals at one or more particular frequencies (e.g., a frequency channel or band), certain parameter values (e.g., particular refresh rates, pixel clock rates, etc.) may be avoided that would result in display 110 emanating undesired interfering signals at these one or more frequencies.

Thus, through the selection of display parameter values, signals associated with display 110 may have frequency components that are outside of the frequency range of operation for the radio module(s). Thus, any interference signals leaking into a radio module's reception components would be of little concern. This is because such interfering signals would be outside the frequency range of the intended received signals and could be mitigated via filtering or other techniques.

Such features may be realized through the exchange of information, such as operational status information 122 and display parameter control directive 124. For instance, operational status information 122 may convey information regarding reception frequencies of radio module 102. In response, display parameter control module 104 may select values for one or more display parameters that having suitable characteristics for the indicated frequencies. Such suitable characteristics may be specified in various ways. For example, suitable parameter values may be ones that cause interference power levels below a predetermined threshold at the indicated reception frequencies. Through control directive 124, display parameter control module 104 may direct display 110 to employ these parameter values.

Figure 1B:
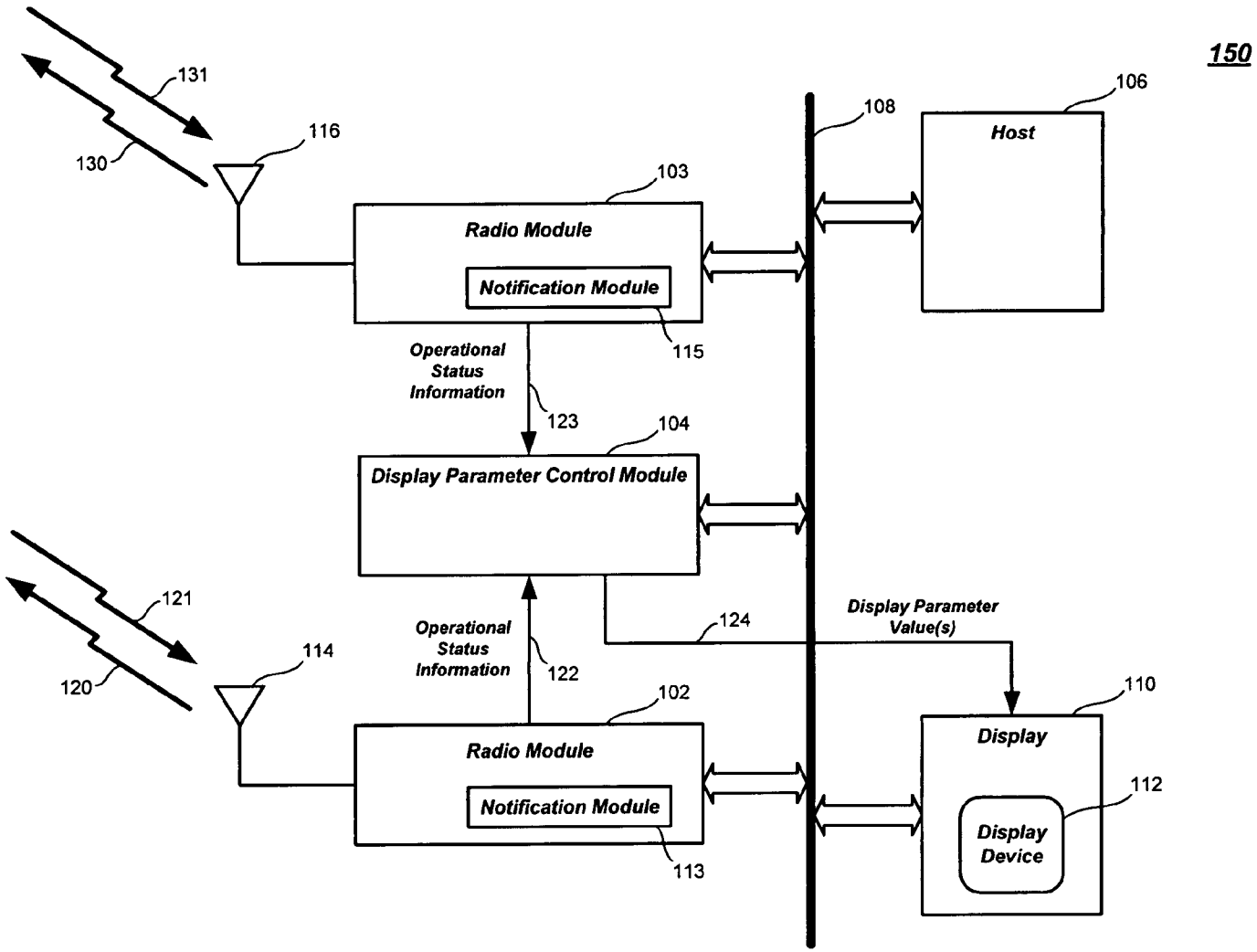
FIG. 1B illustrates a further embodiment of an apparatus.

An example of a further apparatus embodiment is shown in FIG. 1B. In particular, FIG. 1B shows an apparatus 150, which is similar to apparatus 100. However, in addition to radio module 102, apparatus 150 includes a further radio module 103.

As shown in FIG. 1B, radio module 103 may exchange wireless signals 130 and 131 through an antenna 116. These signals may be associated with wireless data networks and/or wireless cellular networks. However, the embodiments are not limited to such networks. To provide for the exchange of such signals, radio module 103 may include components, such as modulators, demodulators, amplifiers, filters, and so forth. Such components may be implemented with hardware (e.g., electronic circuitry), software, firmware, or combinations of these.

In addition to receiving operational status information 122 from radio module 102, FIG. 1B shows that display parameter control module 104 further receives operational status information 123 from radio module 103. This information may also carry information regarding reception frequencies of radio module 103. As shown in FIG. 1B, operational status information 123 may be generated from a notification module 115 within radio module 103.

Thus, in apparatus 150, display parameter control module 104 may select display parameter values having suitable interference characteristics for reception frequencies employed by both radio module 102 and radio module 103. Such suitable characteristics may be specified in various ways. One way designates parameter values that cause interference power levels below a predetermined threshold at the reception frequencies. However, other characteristics may be specified.

As described above, FIGS. 1A and 1B provide exemplary apparatus arrangements. However, the embodiments are not limited to these arrangements. For instance, FIGS. 1A and 1B show host 106 being coupled to one or more radio modules (e.g., radio modules 102 and/or 103) via interconnection medium 108. However, embodiments may include other arrangements.

For example, embodiments may not include a separate host. Also, embodiments may provide an integrated host/radio architecture. In such embodiments, features of a host and one or more radio modules may be implemented together in a single entity, such as a processor or package. Accordingly, a single processor (or processing entity) may provide host and radio module(s). Thus, interconnection medium 108 may be non-physical. More particularly, such interconnectivity may be implemented through messages passed between processes or software modules.

Figure 2:
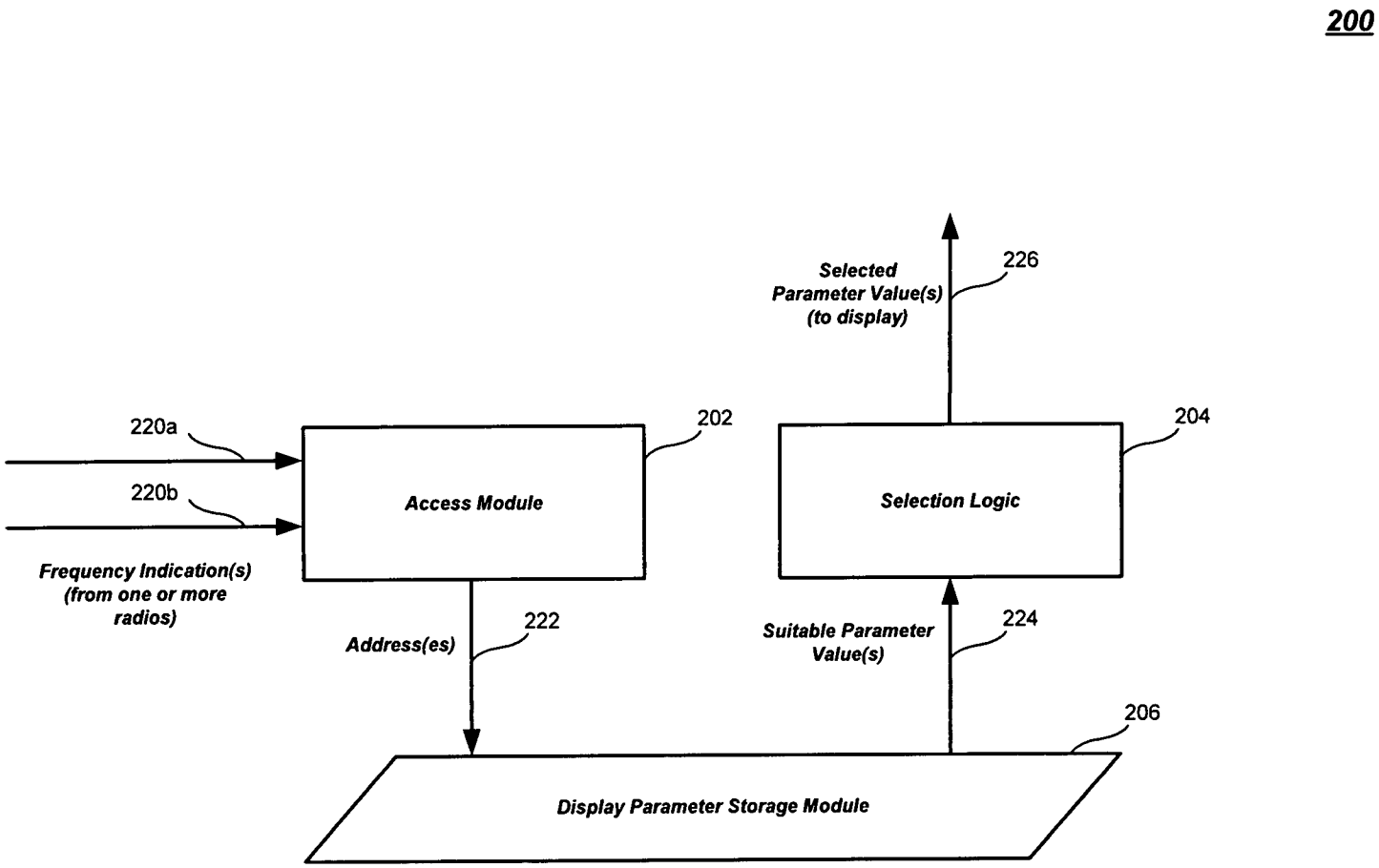
FIG. 2 illustrates an exemplary implementation embodiment that may be included within a display parameter control module.

FIG. 2 is a diagram of an exemplary implementation that may be included in display parameter control module 104. This implementation may comprise various elements. However, the embodiments are not limited to these elements. For instance, embodiments may include other combinations of elements, as well as other couplings between elements.

In particular, FIG. 2 shows an implementation 200, which includes an access module 202, selection logic 204, and a parameter value storage module 206. These elements may be implemented in hardware, software, firmware, or any combination thereof.

Access module 202 may receive one or more frequency indications. For instance, FIG. 2 shows access module 202 receiving a first frequency indication 220*a* and a second frequency indication 220*b*. However, any number of frequency indicators may be received. When implemented in the context of FIG. 1B, frequency indication 220*a* may be conveyed in operational status information 122 from radio module 102, while frequency indication 220*b* may be conveyed in operational status information 123 from radio module 103.

Based on the received frequency indication(s), access module 202 accesses suitable display parameter values from parameter value storage module 206. To provide for this access, parameter value storage module 206 may store one or more correspondences between signal frequencies and suitable display parameter values. For instance, for a particular reception frequency or frequencies (e.g., a frequency range), one or more refresh rates and one or more pixel clock rates may be stored. When employed by a display, these rates may yield acceptable interference levels at the corresponding frequency (or frequencies).

Parameter value storage module 206 may be implemented with a storage medium, such as memory. The correspondences maintained by parameter value storage module 206 may be in the form of a lookup table (LUT). Thus, access module 202 may generate table addresses 222 from frequency indications 220. However, the embodiments are not limited to lookup table implementations. For instance, linked lists, container classes, as well as other arrangements may be employed.

Parameter value storage module 206 outputs its contents corresponding to addresses 222. As shown in FIG. 2, this content comprises one or more suitable display parameter values 224. When implementation 200 receives multiple frequency indications 220 (e.g., indications 220*a* and 220*b*), access module 202 may generate multiple addresses 222 to access multiple sets of suitable display parameter values. These multiple sets are sent to selection logic 204 as suitable display parameter value(s) 224.

FIG. 2 shows that selection logic 204 receives suitable display parameter value(s) 224. From these suitable rate(s), selection logic 204 generates selected parameter value(s) 226. In the context of FIGS. 1A and 1B, these selected value(s) may be sent to display 110 in display parameter control directive 124.

Selection logic 204 chooses parameter value(s) 226 from among the one or more suitable values 224. When suitable value(s) for a particular parameter are in multiple sets, selection logic 204 attempts to select value(s) that are present in each set.

However, if a common suitable rate for a particular parameter does not exist in each set, then selection logic 204 chooses a value from the sets according to one or more selection schemes. Such schemes may be based on various priorities. For example, the earliest arriving set of suitable values may be accorded precedence. Alternatively, certain values may be given priority over others. However, the embodiments are not limited to such schemes.

Figure 3:
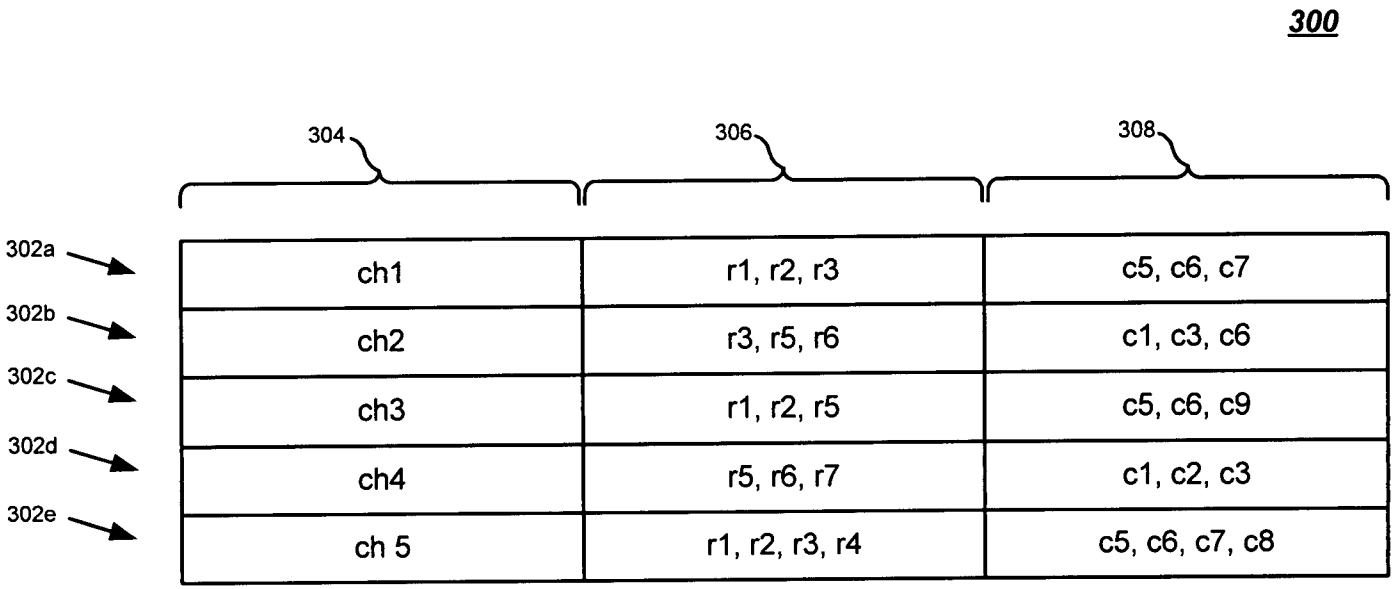
FIG. 3 is a diagram of an exemplary display parameter lookup table

FIG. 3 is a diagram of an exemplary lookup table 300 that may be employed by parameter value storage module 206. As shown in FIG. 3, table 300 includes multiple rows 302*a-e*. In each of these rows, a first column 304 identifies a particular frequency channel. In embodiments, these channels may be represented as table addresses. With reference to FIGS. 1A and 1B, these channels may be employed by radio modules 102 and 103 in the reception of wireless signals. Thus, these channels may be assigned to various wireless communications networks.

FIG. 3 further shows that each of rows 302 also includes a second column 306, which indicates suitable refresh rates for the corresponding frequency channel. For instance, row 302*a* shows that refresh rates r1, r2, and r3 are suitable for a channel ch1. Also, row 302*b* shows that refresh rates r3, r5, and r6 are suitable for a channel ch2.

In addition, each of rows 302 includes a third column 308, which indicates suitable pixel clock rates for the corresponding frequency channel. For example, row 302*a* shows that pixel clock rates c5, c6, and c7 are suitable for channel ch1. Also, row 302*b* shows that pixel clock rates c1, c3, and c6 are suitable for channel ch2.

Referring again to FIG. 2, if frequency indications 220*a* and 220*b* specify reception channels ch1 and ch2, then selection logic 204 will select, as suitable parameter values 224, two sets of suitable refresh rates and two sets of suitable pixel clock rates.

Using lookup table 300, the set of refresh rates corresponding to channel ch1 will include rates r1, r2, and r3, and the set of refresh rates corresponding to channel ch2 will include refresh rates r3, r5, and r6. Moreover, the set of pixel clock rates corresponding to channel ch1 will include c5, c6, and c7, and the set of pixel clock rates corresponding to channel ch2 will include c1, c3, and c6.

Upon receipt of these sets, selection logic 204 may establish refresh rate r3 and pixel clock rate c6 as the selected parameter values 226, because they are suitable for both channels ch1 and ch2.

Operations for the above embodiments may be further described with reference to the following figures and accompanying examples. Some of the figures may include a logic flow. Although such figures presented herein may include a particular logic flow, it can be appreciated that the logic flow merely provides an example of how the general functionality as described herein can be implemented. Further, the given logic flow does not necessarily have to be executed in the order presented, unless otherwise indicated. In addition, the given logic flow may be implemented by a hardware element, a software element executed by a processor, or any combination thereof. The embodiments are not limited in this context.

Figure 4:
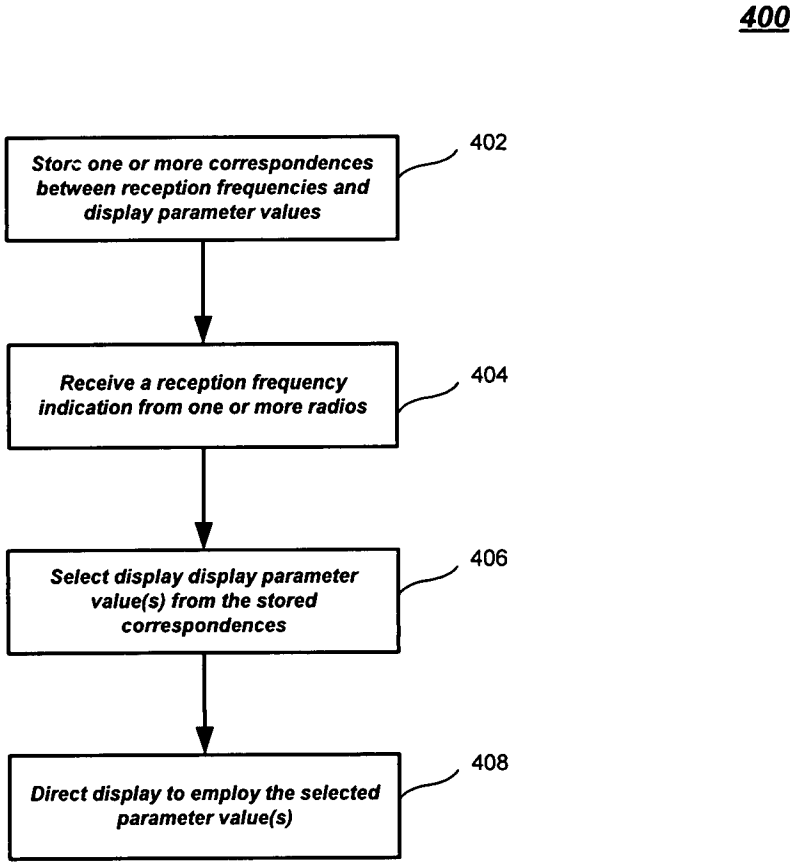
FIG. 4 illustrates one embodiment of a logic diagram.

FIG. 4 illustrates one embodiment of a logic flow. In particular, FIG. 4 illustrates a logic flow 400, which may be representative of the operations executed by one or more embodiments described herein.

As shown in logic flow 400, a block 402 stores one or more correspondences. Each of these correspondences may indicate one or more suitable operational parameter values for one or more signal frequencies. With reference to FIG. 2, this storage may be implemented in parameter value storage module 206.

A block 404 receives indication(s) of one or more reception frequencies. Such indications may be received from one or more radio modules, such as radio modules 102 and/or 103.

Based on these indication(s), a block 406 selects one or more parameter values from the correspondences stored by block 402. The selected parameter values may be suitable for the one or more indicated reception frequencies. Referring to FIG. 2, block 402 may be implemented with selection logic 204.

Upon selection, a block 408 may direct a display to employ the selected parameter values. With reference to FIGS. 1A and 1B, this feature may be implemented with display parameter control directive 124.

Figure 5:
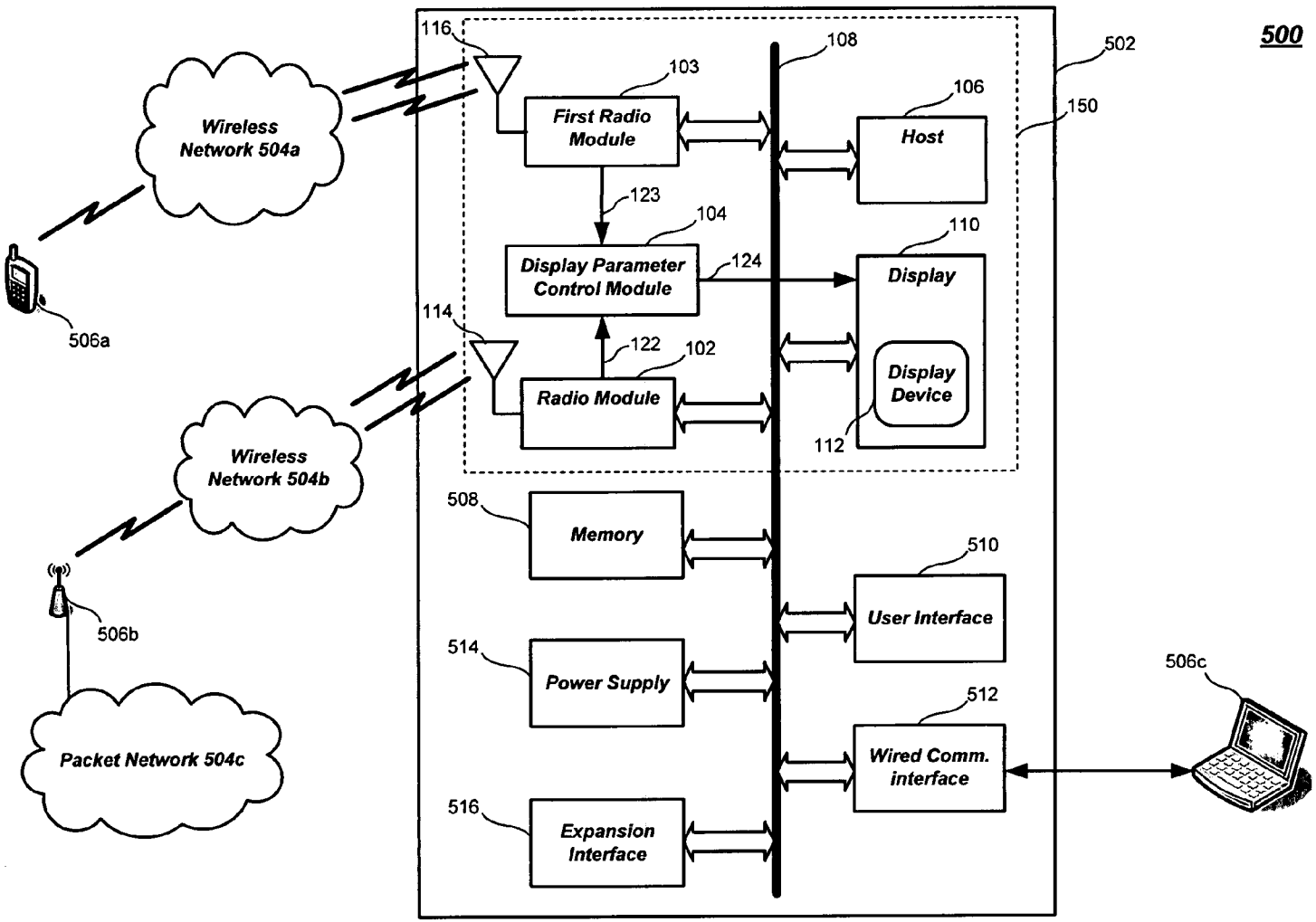
FIG. 5 illustrates one embodiment of a system.

FIG. 5 illustrates an embodiment of a system 500. This system may be suitable for use with one or more embodiments described herein, such as apparatus 100, apparatus 150, implementation 200, logic flow 400, and so forth. Accordingly, system 500 may engage in wireless communications across various link types, such as the ones described herein. In addition, system 500 may perform various user applications.

As shown in FIG. 5, system 500 may include a device 502, multiple communications networks 504, and one or more remote devices 506. FIG. 5 shows that device 502 may include the elements of FIG. 1B. However, device 502 may alternatively include the elements of FIG. 1A, as well as elements of other embodiments. As described above, such other embodiments may involve integrated host/radio architectures.

Also, FIG. 5 shows that device 502 may include a memory 508, a user interface 510, a wired communications interface 512, a power supply 514, and an expansion interface 516. These elements may be implemented in hardware, software, firmware, or any combination thereof.

Memory 508 may store information in the form of data. For instance, memory 508 may contain application documents, e-mails, sound files, and/or images in either encoded or unencoded formats. Alternatively or additionally, memory 508 may store control logic, instructions, and/or software components. These software components include instructions that can be executed by one or more processors. Such instructions may provide functionality of one or more elements in system 500. Exemplary elements include host 106, one or more components within radio modules 102 and 103, display parameter control module 104, display 110, user interface 510, and/or communications interface 512. Further, with reference to FIG. 2, parameter value storage module 206 may be provided by memory 508.

Memory 508 may be implemented using any machine-readable or computer-readable media capable of storing data, including both volatile and non-volatile memory. For example, memory 508 may include read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory, polymer memory such as ferroelectric polymer memory, ovonic memory, phase change or ferroelectric memory, silicon-oxide-nitride-oxide-silicon (SONOS) memory, magnetic or optical cards, or any other type of media suitable for storing information. It is worthy to note that some portion or all of memory 508 may be included in other elements of system 500. For instance, some or all of memory 508 may be included on a same integrated circuit or chip with elements of apparatus 100 and/or apparatus 150. Alternatively some portion or all of memory 508 may be disposed on an integrated circuit or other medium, for example a hard disk drive, which is external. The embodiments are not limited in this context.

User interface 510 facilitates user interaction with device 502. This interaction may involve the input of information from a user and/or the output of information to a user. Accordingly, user interface 510 may include one or more devices, such as a keyboard (e.g., a full QWERTY keyboard), a keypad, a touch screen, a microphone, and/or an audio speaker.

Wired communications interface 512 provides for the exchange of information with a device 506*c* (e.g., a proximate device), such as a personal computer. This exchange of information may be across one or more wired connections. Examples of such connections include USB interfaces, parallel interfaces, and/or serial interfaces. In addition, interface 512 may provide for such exchanges across wireless connections(s). An infrared interface is an example of such a connection. The information exchanged with such proximate devices, may include e-mail, calendar entries, contact information, as well as other information associated with personal information management applications. In addition, such information may include various application files, and content (e.g., audio, image, and/or video).

Wired communications interface 512 may include various components, such as a transceiver and control logic to perform operations according to one or more communications protocols. In addition, communications interface 512 may include input/output (I/O) adapters, physical connectors to connect the I/O adapter with a corresponding communications medium.

FIG. 5 shows that device 502 may communicate across wireless networks 504*a* and 504*b*. In particular, FIG. 5 shows communications across network 504*a* being handled by second radio module 103, and communications across network 504*b* being handled by first radio module 102. Accordingly, first wireless network 504*a* may be a cellular network, while second wireless network 504*b* may be a wireless data network. However, the embodiments are not limited to these examples.

Such wireless communications allow device 502 to communicate with various remote devices. For instance, FIG. 5 shows device 502 engaging in wireless communications (e.g., telephony or messaging) with a mobile device 506*a*. In addition, FIG. 5 shows device engaging in wireless communications (e.g., WLAN, WMAN, and/or PAN communications) with an access point 506*b*. In turn access point 506*b* may provide device 502 with access to further communications resources. For example, FIG. 5 shows access point 506*b* providing access to a packet network 504*c*, such as the Internet.

Power supply 514 provides operational power to elements of device 502. Accordingly, power supply 514 may include an interface to an external power source, such as an alternating current (AC) source. Additionally or alternatively, power supply 514 may include a battery. Such a battery may be removable and/or rechargeable. However, the embodiments are not limited to these examples.

Expansion interface 516 may be in the form of an expansion slot, such as a secure digital (SD) slot. Accordingly, expansion interface 516 may accept memory, external radios (e.g., global positioning system (GPS), Bluetooth, WiFi radios, etc.), content, hard drives, and so forth. The embodiments, however, are not limited to SD slots. Other expansion interface or slot technology may include memory stick, compact flash (CF), as well as others.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Some embodiments may be implemented, for example, using a machine-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising:

a storage medium storing one or more correspondences;

a display capable of employing multiple values for one or more operational parameters, wherein each correspondence indicates one or more suitable operational parameter values for reducing interference for one or more signal frequencies, and wherein the interference is generated by one or more interfering signals associated with the display;

a first receiver to receive a first wireless signal having one or more first reception frequencies;

a second receiver to receive a second wireless signal having one or more second reception frequencies; and a controller to:

receive a first indication of the one or more first reception frequencies from the first receiver;

receive a second indication of the one or more second reception frequencies from the second receiver;

determine whether the one or more stored correspondences include an operational parameter value that causes the one or more interfering signals to be outside of both the one or more first reception frequencies and the one or more second reception frequencies;

in response to a determination that the one or more stored correspondences include an operational parameter value that causes the one or more interfering signals to be outside of both the one or more first reception frequencies and the one or more second reception frequencies, select the operational parameter value for controlling the display; and in response to a determination that the one or more stored correspondences do not include an operational parameter value that causes the one or more interfering signals to be outside of both the one or more first reception frequencies and the one or more second reception frequencies, select an operational parameter value according to a priority scheme such that the one or more interfering signals associated with the display are outside of the one or more first reception frequencies or are outside of the one or more second reception frequencies.

2. The apparatus of claim 1, wherein the selected operational parameter value includes a refresh rate and/or a pixel clock rate.

3. The apparatus of claim 1, wherein the controller is to select at least one corresponding operational parameter value for the display from the storage medium.

4. The apparatus of claim 1, wherein the controller is to direct the display to employ the selected operational parameter value.

5. The apparatus of claim 1, wherein the first receiver comprises a first notification module to provide the controller with the indication of the one or more first reception frequencies, and wherein the second receiver comprises a second notification module to provide the controller with the indication of the one or more second reception frequencies.

6. The apparatus of claim 1, wherein the display is a liquid crystal display (LCD).

7. The apparatus of claim 1, wherein the first wireless signal is a wireless cellular signal.

8. The apparatus of claim 1, wherein the first wireless signal is a wireless data networking signal.

9. An apparatus, comprising:

means for storing one or more correspondences, wherein each correspondence indicates one or more suitable operational parameter values for reducing interference for one or more signal frequencies, and wherein the interference is generated by one or more interfering signals associated with a display;

means for receiving a first wireless signal having one or more first reception frequencies;

means for receiving a second wireless signal having one or more second reception frequencies, wherein the interference generated by the one or more interfering signals associated with the display includes radiated interference or conductive interference that is receivable by the means for receiving the first wireless signal and the means for receiving the second wireless signal and that is capable of interfering with the reception of the first wireless signal by the means for receiving the first wireless signal and the reception of the second wireless signal by the means for receiving the second wireless signal;

means for receiving an indication of the one or more first reception frequencies from the means for receiving the first wireless signal and for receiving an indication of the one or more second reception frequencies from the means for receiving the second wireless signal;

means for determining whether the one or more stored correspondences include an operational parameter value that causes the one or more interfering signals to be outside of both the one or more first reception frequencies and the one or more second reception frequencies;

means for selecting the operational parameter value for controlling the display in response to a determination that the one or more stored correspondences include an operational parameter value that causes the one or more interfering signals to be outside of both the one or more first reception frequencies and the one or more second reception frequencies; and means for selecting an operational parameter value according to a priority scheme in response to a determination that the one or more stored correspondences do not include an operational parameter value that causes the one or more interfering signals to be outside of both the one or more first reception frequencies and the one or more second reception frequencies, wherein the operational parameter value selected according to the priority scheme causes the one or more interfering signals to be outside of the one or more first reception frequencies or are outside of the one or more second reception frequencies.

10. The apparatus of claim 9, further comprising means for directing the display to employ the selected operational parameter value.

11. The apparatus of claim 9, wherein the display is a liquid crystal display (LCD).

12. A method, comprising:

storing one or more correspondences, each correspondence indicating one or more suitable operational parameter values for reducing interference for one or more signal frequencies, and wherein the interference is generated by one or more interfering signals associated with a display;

receiving, by a control module, a first indication of one or more first reception frequencies for a first wireless signal received by a first radio module and a second indication of one or more second reception frequencies for a second wireless signal received by a second radio module, wherein the interference generated by the one or more interfering signals associated with the display includes radiated interference or conductive interference that is receivable by the first radio module and the second radio module and that is capable of interfering with the reception of the first wireless signal by the first radio module and the reception of the second wireless signal by the second radio module; p1 determining whether the one or more stored correspondences include an operational parameter value that causes the one or more interfering signals to be outside of both the one or more first reception frequencies and the one or more second reception frequencies;

in response to a determination that the one or more stored correspondences include an operational parameter value that causes the one or more interfering signals to be outside of both the one or more first reception frequencies and the one or more second reception frequencies, selecting the operational parameter value for controlling the display; and in response to a determination that the one or more stored correspondences do not include an operational parameter value that causes the one or more interfering signals to be outside of both the one or more first reception frequencies and the one or more second reception frequencies, selecting an operational parameter value according to a priority scheme such that the one or more interfering signals associated with the display are outside of the one or more first reception frequencies or are outside of the one or more second reception frequencies.

13. The method of claim 12, wherein the selected operational parameter value includes a refresh rate and/or a pixel clock rate.

14. The method of claim 12, further comprising directing the display to employ the selected operational parameter value.

15. The method of claim 14, wherein the display is a liquid crystal display (LCD).

16. The method of claim 12, wherein the conductive interference generated by the display occurs when display driving signals propagate to components of the first radio module via a ground loop, a trace, a power plane, or combinations thereof, and wherein, when the selected operational parameter value is employed by the display, the conductive interference is outside of the one or more first reception frequencies.

17. A non-transitory computer-readable storage medium storing instructions that, when executed by a processor, cause the processor to:

store one or more correspondences, each correspondence indicating one or more suitable operational parameter values for reducing interference for one or more signal frequencies, wherein the interference is generated by one or more interfering signals associated with a display;

receive, with a first radio module, a first wireless signal having one or more first reception frequencies, wherein the interference generated by the display includes radiated interference or conductive interference that is receivable by the radio module and that is capable of interfering with the reception of the wireless signal by the radio module;

receive, with a second radio module, a second wireless signal having one or more second reception frequencies;

receive a first indication of the one or more reception first frequencies from the first radio module and a second indication of the one or more second reception frequencies from the second radio module;

determine whether the one or more stored correspondences include an operational parameter value that causes the one or more interfering signals to be outside of both the one or more first reception frequencies and the one or more second reception frequencies;

in response to a determination that the one or more stored correspondence include an operational parameter value that causes the one or more interfering signals to be outside of both the one or more first reception frequencies and the one or more second reception frequencies, select the operational parameter value for controlling the display; and in response to a determination that the one or more stored correspondences do not include an operational parameter value that causes the one or more interfering signals to be outside of both the one or more first reception frequencies and the one or more second reception frequencies, select an operational parameter value according to a priority scheme such that the one or more interfering signals associated with the display are outside of the one or more first reception frequencies or are outside of the one or more second reception frequencies.

* * * * *